United States Patent [19]

Pettersson

[11] 3,964,617

[45] June 22, 1976

[54] ARRANGEMENT FOR THE STACKING IN A SPACE-SAVING MANNER OF TETRAHEDRAL PACKING UNITS IN A PRISMATIC COLLECTIVE CONTAINER

[75] Inventor: Leif B. Pettersson, Staffanstorp, Sweden

[73] Assignee: AB Ziristor, Lund, Sweden

[22] Filed: Nov. 13, 1974

[21] Appl. No.: 523,543

[30] Foreign Application Priority Data

Dec. 18, 1973 Sweden ..... 73170532

[52] U.S. Cl. ..... 214/10.5 R; 53/142; 53/390; 206/436

[51] Int. Cl.[2] ..... B65D 85/54; B65G 1/14

[58] Field of Search ..... 53/142, 390; 214/10.5 R; 206/436

[56] References Cited

UNITED STATES PATENTS 3,831,835 8/1974 Guhl ..... 53/142

*Primary Examiner*—Robert J. Spar
*Assistant Examiner*—George F. Abraham
*Attorney, Agent, or Firm*—Pierce, Scheffler & Parker

[57] ABSTRACT

An arrangement for stacking tetrahedral packing units in layers in a space-saving manner in a prismatic collective container from the bottom up in which the bottom wall of the container is provided with an array of openings through which a corresponding array of supporting members are inserted and engage respectively with an inclined wall of each of six regular tetrahedral packing units which form the bottommost layer. When the bottom layer has been so loaded into the container three additional six-unit layers are loaded in succession into the container after which the supports can then be withdrawn and the four layers so loaded into the container will be automatically retained in the position in which they have been stacked.

7 Claims, 4 Drawing Figures

Figure 1:
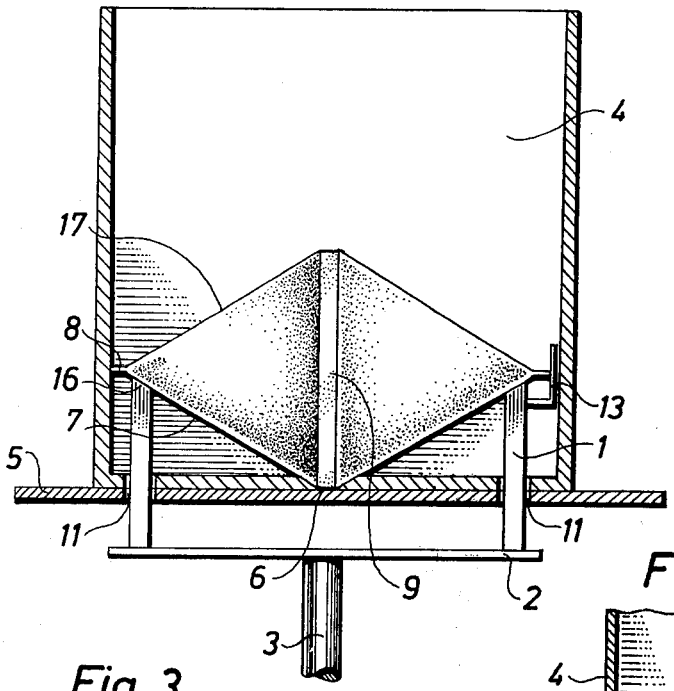

ARRANGEMENT FOR THE STACKING IN A SPACE-SAVING MANNER OF TETRAHEDRAL PACKING UNITS IN A PRISMATIC COLLECTIVE CONTAINER

The present invention relates to an arrangement for the stacking in a space-saving manner of tetrahedral packing units in a prismatic collective container, the said tetrahedral packing units being loaded in layers with a number of packages, preferably six units, in each layer. The invention also relates to a collective container capable of taking up tetrahedral packing units arranged in layers and intended to be used in conjunction with the abovementioned arrangement.

Tetrahedral disposable packages for liquid goods have been on the market for a long time and it has been found that these tetrahedral packing units, owing to their sharp edges and the angle between their sides, cannot readily be stacked in the normally occuring stacking containers in the form of parallelepipedic cartons or trays. To allow the transport and handling of the said tetrahedral packing units a special collective container has been developed consisting of trays or cartons with hexagonal cross-section and with a pyramidal base (Swedish pat. No. 150 453). In this specially developed collective container the tetrahedral packing units are stacked with their side surfaces resting against one another or against the base or side walls of the collective container, without any of the pointed corners of the tetrahedral packing units pointing directly towards a side surface of an adjoining packing unit. These known collective containers, comprising preferably three layers of tetrahedral packages with six units in each layer, that is to say, a total of eighteen packing units, have been found to work well and to give a good protection to the packing units during their transport and handling. One disadvantage of these transport containers is that they have a pyramidal base and thus a bottom space that is not fully utilized. It was found subsequently that the same stacking pattern of tetrahedral units can also be applied in parallelepipedic transport containers, but here too it was necessary to introduce an insert in the base of the container in the form of a pyramidal base plane, and in this case too a relatively poor utilization of the volume of the transport container is obtained.

In order to avoid providing the transport container with a pyramidal supporting base, which beside being space-wasting is also relatively expensive and difficult to manufacture, it has been proposed to replace the said pyramidal base with a layer of tetrahedral packing units arranged adjacent to one another, which are intended to be placed directly against the plane base of a transport container with hexagonal or rectangular cross-section, the upper side surfaces of the tetrahedral packages placed in the transport container jointly forming a pyramidal base surface with approximately the same top angle and angle between the side walls of the transport containers and the pyramidal base plane, as is obtained when a transport container in a known manner is provided with a pyramidal base. On this pyramidal base plane, which is formed by a layer of tetrahedral packing units arranged adjacent to one another, a further three layers may then be arranged in known manner in the stacking described earlier, the transport container or collective container then comprising four layers of tetrahedral packing units instead of the three as is the case in the stacking known previously. The result is therefore that the collective container will comprise twenty-four packing units instead of eighteen packages, arranged so that there are six tetrahedral units in each layer, although the height of the collective container need only be increased by an amount corresponding to the height of half a stacking layer of tetrahedral packages.

It is not necessary to arrange six tetrahedral packing units in each layer, but the number of packing units which is arranged in one and the same layer will depend of course upon the angle between sides of the packing units which together must make up 360°. Since the angle between the sides in a regular tetraheder is 60°, and the most common commercial tetrahedral packing units closely approach the regular tetrahedral shape, each layer or bed of tetrahedral packages will therefore under normal circumstances contain six packing units.

If in a collective container or transport container with a plane base it is attempted to introduce a bottom layer of tetrahedral packing units whose combined angle between sides is approximately 360°, that is to say, the packing units will jointly substantially fill out the bottom space, it will be found that the tetrahedral sides facing towards the base of the collective container will be fully resting against the base plane, whilst the upper sides of the tetrahedral packages loaded will not form a coherent pyramidal plane but will instead form a number of triangular surfaces, which are not arranged so that they adjoin one another. It is necessary, therefore, that in the loading of the tetrahedral packing units a support has to be provided when the bottom layer of the tetrahedral package is loaded and this problem is solved by means of an arrangement in accordance with the invention and with the help of a specially designed collective container, which is intended to co-operate with the said arrangement. The arrangement in accordance with the invention is characterized in that the said arrangement comprises one or more movably arranged supports, which are adapted so that during the filling of the collective container with packing units they can be introduced into the container through openings with the object of constituting stacking supports for the tetrahedral packing units introduced into the container, and the collective container in accordance with the invention is characterized in that the base of the collective container or its sidewalls have openings, the number of which corresponds at least to the number of supports which are adapted to be introduced into the collective container.

Figure 2:
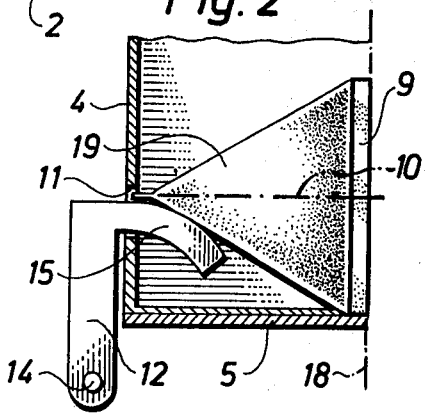
Figure 3:
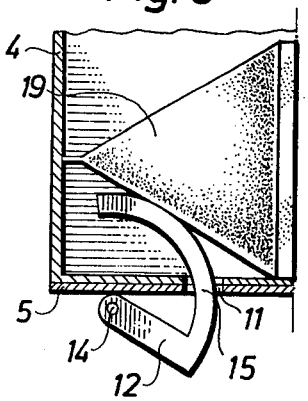
Figure 4:
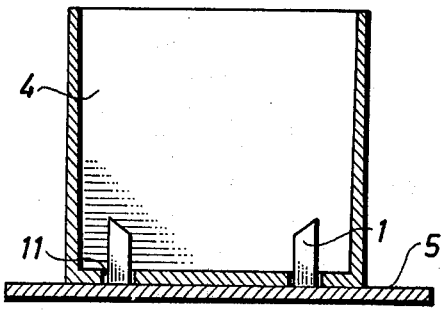

In the following will be described some embodiments of the invention with reference to the enclosed schematic drawings in which FIG. 1 shows a cross section of a collective container into which is introduced a base layer of tetrahedral packing units with the help of supports introduced into the collective container, FIG. 2 shows an alternative realization of the support which is used in connection with the loading of the packing units, FIG. 3 shows an alternative design of the support in accordance with FIG. 2 and FIG. 4 shows a fixed support arranged on a mounting table.

The arrangement shown in FIG. 1 comprises a mounting table 5 onto which it is intended that the collective container 4 should be placed in connection with the loading of the tetrahedral packing units into the collective container 4. Before the first layer of packing units is placed in the collective container 4, the supports 1 arranged on the plate 2 are pushed up by means of the manoeuvering rod 3 through the table 4, and through the openings 11 provided in the base of the collective container 4, into the collective container 4, and into the position shown in FIG. 1. In order to provide the front surface 16 of the supports 1 with a large supporting surface against the side 7 of the packing units, it is appropriate to bevel the front edges of the supports and, as can be seen from the figure, the supports 1 are pushed into the collective containers 4 to such an extent that the bottom layer of the tetrahedral packing units placed next to one another will end up with their edge fins 9 directed towards one another, lying parallel with one another and substantially along the vertical axis of the container 4, and the lower ends 6 of the edge fins 9 resting against the base of the collective container.

As pointed out earlier, when regular tetrahedral packages with an angle between sides of approx. 60° are stacked each layer of tetrahedral packages will comprise six packing units, which means that the supporting device must have six supports 1, that is to say, at least one support for each packing unit. When the bottom layer of tetrahedral packing units has been loaded, the upwards-facing sides 17 of the packing units will jointly form a pyramidal surface which, in the manner described previously, can constitute a stacking support for a further three layers of packing units each, in the normal case, comprising six packages. The second layer of packing units is placed directly above the pyramidal bottom layer formed, with the triangular sides arranged in such a manner that they cover each other. The third layer is arranged in accordance with the earlier mentioned Swedish pat. specification No. 150 453, in that the tetrahedral packages are inserted in the interspaces which are formed between the packing units of the second layer, whilst the fourth and last layer of packages is either made to assume the same position as the second layer or else the packages are made to rest directly against the packages of the third layer, that is to say, the triangular sides cover one another.

To prevent the packing units of the second layer from sliding out towards the walls of the collective container it is suitable to provide a supporting edge 13 on the side of the supports which is facing towards a near wall of the collective container, against which supporting edge 13 the sealing fins 8 of the packing units are made to rest.

When the collective container 4 has been filled with the intended number of tetrahedral packing units, the supports 1 may be withdrawn from the collective container 4 by moving them with the help of the manoeuvring rod 3 downwards and out through the openings arranged in the base of the collective container 4, to a position where the supports are wholly outside the collective container 4. When the supports 1 have been withdrawn, the bottom layer of tetrahedral packing units will be locked in the configuration imparted to it because of the layers of tetrahedral packages placed on top of the bottom layer, which lie in direct surface contact with the triangular, upwards-facing sides 17 of the bottom layer of the tetrahedral packages. When the filled collective containers 4 is subjected to jolts and shocks, e.g. in connection with transport, it is found that a certain sinking in of the bottom layer of tetrahedral packages takes place, but owing to the abovementioned self-locking of the tetrahedral packages arranged in the collective container 4, the original stacking by and large will retain its configuration. Moreover, the collective container 4 must be dimensioned so in relation to the upwards directed edge portions of the tetrahedral packing units, which generally consist of a flat sealing fin 8, that these edge portions will receive support from the side walls of the collective container 4.

The variant of the arrangement in accordance with the invention shown in FIG. 2 comprises a number of axes of rotation 14 and pivoting arms 12 which in their function replace the supports 1, manoeuvrable in upwards and downwards direction, of FIG. 1. As in FIG. 1, the collective container is designated by numeral 4 and the table on which the collective container 4 stands by numeral 5. For the sake of simplicity only a cross-section of one half of the lower part of the collective container 4 has been illustrated in the figure and the axis of symmetry of the collective container has been designated 18 whilst the tetrahedral packing units have been given numeral 19. The stacking support for the tetrahedral packing units 19 introduced into the collective container 4 consists in the version shown in FIG. 2 of a supporting bar 15 which is connected to the pivoting arm 12. The supporting bar 15 is intended to be introduced through an opening 11 into the collective container 4 by swivelling the arm 12 around its axis of rotation 14, the supporting bar 15 being introduced into the collective container to the intended supporting position in which the axes of symmetry 10 of the tetrahedral packing units 19 will come to lie parallel with the base plane of the collective container 4, whilst the edge lines 9 of the tetrahedral packing units 19, which most frequently consist of sealing fins pressed flat, are arranged vertically and substantially coinciding with the axis of symmetry 18 of the collective container 4.

So as to avoid having to make the inlet openings 11 too large, it is appropriate to design the supporting bar 15 as a part of a segment of a circle or a ring whose centre is constituted by the axis of rotation 14. To facilitate the manoeuvring of the supporting bars 15 it is possible to provide around one and the same axis of rotation 14, e.g. two arms 12 with associated supporting bars 15, which are introduced at the same time into the collective container. In the case shown in FIG. 2 it is likewise necessary to support each individual tetrahedral packing unit 19 and when, in the normal case, each layer of tetrahedral packing units contains six packing units, it is appropriate to provide six supporting bars 15, which, however, may be arranged in such a manner that two supporting bars are introduced through two of the sidewalls of the collective container whilst only one supporting bar 15 is introduced through the remaining side walls of the collective container 4.

In FIG. 3 is shown how the supporting bar 15, instead of being introduced through the side walls of the collective container 4 can be introduced through the base of the collective container through openings 11 provided in the base part. For the rest, the function of the supporting device illustrated in FIG. 3 is the same as that shown in FIG. 2 and the supporting bar 15 constitutes a part of a circular ring whose centre point is the axis of rotation 14. The advantage of the arrangement in accordance with FIG. 3 compared with the arrangement in FIG. 1 is that the space requirement below the table 5 is smaller in the arrangement according to FIG. 3.

A further version of a supporting arrangement is shown in FIG. 4, where the arrangement consists of a supporting table 5 with fixed supporting posts 1. In this case the collective container 4 provided with openings 11 is placed over the supporting posts 1 in such a manner that these will project into the collective container 4 through the openings 11. The tetrahedral packing units can now be loaded in the manner described earlier into the collective container 4 and when the stacking and the placing of the tetrahedral packing units has been completed, the collective container together with the tetrahedral packing units loaded therein is lifted vertically upwards so that the collective container 4 is disengaged from the supporting pillars 1.

It is possible to perform the loading of the tetrahedral packages manually or mechanically and if an automatic machine is used it is advantageous in the loading process to introduce a complete layer of tetrahedral packages into the collective container 4. This may be done with specially arranged automatic loading devices, by means of which a complete layer of tetrahedral packages, which has been assembled in a matrix, is gripped by a loading arm, which is provided with suction heads or similar gripping devices, whereupon the complete layer is lifted out of the matrix and is transferred to the collective container 4. In such a manner layer after layer of tetrahedral packing units can be transferred to the collective container 4 until the latter is finally filled with packing units, that is generally twenty-four packing units arranged in four layers, with six units in each layer.

To allow the collective container 4 in accordance with the invention, to co-operate with the supporting devices described, it has to be provided with openings through which the supporting devices can be introduced into the collective container, and it is appropriate not to make the said openings too big, since these openings would otherwise detrimentally affect the stability and strength of the collective container. Hence the openings must be arranged in the collective container 4 in such a manner that they correspond in their shape and in their number to the number of supporting posts or supporting bars which are adapted to be introduced into the collective container, and under normal circumstances the said openings should be arranged in the collective container at a distance from the bottom edge of the collective container which corresponds to a maximum of one half of the length of edge of the tetrahedral packing units.

It has been found that arrangements in accordance with the invention are cheap to manufacture and reliable in operation and that the collective containers which are manufactured in accordance with the invention function well and give the intended protection to the tetrahedral packing units placed into the collective container.

The collective containers may be of the conventional type with hexagonal or rectangular cross-section and with a plane base, but as described above, the collective containers must be provided with openings which make it possible to introduce the stacking supports for the first layer of tetrahedral packages introduced into the collective containers. The collective containers may be made of e.g. cardboard material or else of plastic or metal and the arrangement in accordance with the invention can be combined very well with already existing automatic loading arrangements.

I claim:

1. A device for stacking a plurality of tetrahedral packing units in a space saving manner in a prismatic container therefor in which the tetrahedral packing units are arranged in a plurality of superposed layers, in the bottom layer of which a corresponding edge of each package unit extends vertically substantially along the vertical axis of the prismatic container and parallel to each other, the lower end of the corresponding edges resting on the bottom of the prismatic container, the upper layers being arranged in alternate nesting relation with the bottom layer, said device comprising a plurality of retractable support means for insertion into and withdrawal from the prismatic container through openings provided therein for receiving said retractable support means, said support means, when inserted into the prismatic container during stacking of the tetrahedral units therein, supporting each tetrahedral packing unit in the bottom layer on the lower surface of each such unit, and means for inserting and subsequently withdrawing said support means after stacking said plurality of tetrahedral packing units in said prismatic container the upper layers of the tetrahedral packing units preventing displacement of the units in the bottom layer when said support means is withdrawn.

2. A device as claimed in claim 1 wherein each tetrahedral packing unit is supported by one retractable support means.

3. A device as claimed in claim 1 wherein each retractable support means comprising an arm pivoted at one end thereof and a curved support arm extending laterally from the other end thereof whereby when said pivotable arm is turned the curved support arm will enter an opening in the prismatic container to support one of the packing units in the bottom layer.

4. A device as claimed in claim 3 wherein the curved support arm is a circular segment having its center of curvature at the pivot of said pivotable arm.

5. A device as claimed in claim 1 wherein each retractable support means comprises a vertically extending rod, a base plate for carrying said vertical rods and means for providing said base plate with reciprocating movement in a vertical direction to move said rods upwardly through the openings in the prismatic container to support said tetrahedral packing units during stacking and to withdraw said rods from the prismatic container after stacking.

6. A device as claimed in claim 1 wherein the openings in the prismatic container are disposed in the bottom of said container at a distance from the side walls thereof not more than one half the length of one edge of the tetrahedral packing unit.

7. A device as claimed in claim 1 wherein the number of openings in the prismatic container for receiving said support means, is at least equal to the number of said support means.

* * * * *